US009462380B2

(12) United States Patent
McCowan

(10) Patent No.: US 9,462,380 B2
(45) Date of Patent: Oct. 4, 2016

(54) MICROPHONE ARRAY SYSTEM AND A METHOD FOR SOUND ACQUISITION

(71) Applicant: Biamp Systems Corporation, Beaverton, OR (US)

(72) Inventor: Iain Alexander McCowan, Southport (AU)

(73) Assignee: Biamp Systems Corporation, Beaverton, OR (US)

( * ) Notice: Subject to any disclaimer, the term of this patent is extended or adjusted under 35 U.S.C. 154(b) by 0 days.

(21) Appl. No.: 14/090,912

(22) Filed: Nov. 26, 2013

(65) Prior Publication Data

US 2015/0146882 A1 May 28, 2015

Related U.S. Application Data

(63) Continuation of application No. 13/061,359, filed as application No. PCT/AU2009/001100 on Aug. 26, 2009, now Pat. No. 8,923,529.

(30) Foreign Application Priority Data

Aug. 29, 2008 (AU) ..... 2008904477

(51) Int. Cl.
*H04R 3/00* (2006.01)

(52) U.S. Cl.
CPC ..... *H04R 3/005* (2013.01); *H04R 2430/03* (2013.01)

(58) Field of Classification Search
CPC ..... H04R 3/005; H04R 2430/03; H04R 3/00
USPC ..... 381/92
See application file for complete search history.

(56) References Cited

U.S. PATENT DOCUMENTS 4,254,417 A 3/1981 Speiser
4,262,170 A 4/1981 Bauer (Continued)

FOREIGN PATENT DOCUMENTS

DE 3512155 A1 10/1985
EP 0781070 A1 6/1997

(Continued)

OTHER PUBLICATIONS

European Search Report dated Mar. 19, 2014 corresponding to European Patent App. No. 13177034.9, 10 pp.

(Continued)

*Primary Examiner* — Paul S Kim
(74) *Attorney, Agent, or Firm* — Dascenzo Intellectual Property Law, P.C.

(57) ABSTRACT

A microphone array system for sound acquisition from multiple sound sources in a reception space surrounding a microphone array that is interfaced with a beamformer module is disclosed. The microphone array includes microphone transducers that are arranged relative to each other in N-fold rotationally symmetry, and the beamformer includes beamformer weights that are associated with one of a plurality of spatial reception sectors corresponding to the N-fold rotational symmetry of the microphone array. Microphone indexes of the microphone transducers are arithmetically displaceable angularly about the vertical axis during a process cycle, so that a same set of beamformer weights is used selectively for calculating a beamformer output signal associated with any one of the spatial reception sectors. A sound source location module is also disclosed that includes a modified steered power response sound source location method. A post filter module for a microphone array system is also disclosed.

16 Claims, 9 Drawing Sheets

(56) References Cited

U.S. PATENT DOCUMENTS

| | | | |
|---|---|---|---|
| 4,311,874 | A | 1/1982 | Wallace, Jr. |
| 4,675,906 | A | 6/1987 | Sessler et al. |
| 4,752,961 | A | 6/1988 | Kahn |
| 4,802,227 | A | 1/1989 | Elko et al. |
| 5,506,908 | A | 4/1996 | Baumhauer, Jr. et al. |
| 6,041,127 | A | 3/2000 | Elko |
| 6,198,693 | B1 | 3/2001 | Marash |
| 6,847,403 | B1 | 1/2005 | Forsberg, Jr. et al. |
| 6,868,045 | B1 | 3/2005 | Schröder |
| 6,980,485 | B2 | 12/2005 | McCaksill |
| 7,065,220 | B2 | 6/2006 | Warren et al. |
| 7,068,801 | B1 | 6/2006 | Stinson et al. |
| 7,092,882 | B2 | 8/2006 | Arrowood et al. |
| 7,203,132 | B2 | 4/2007 | Berger |
| 7,251,336 | B2 | 7/2007 | Amiri et al. |
| 7,415,117 | B2 | 8/2008 | Tashev et al. |
| 7,428,000 | B2 | 9/2008 | Cutler et al. |
| 7,565,288 | B2 | 7/2009 | Acero et al. |
| 7,630,503 | B2 | 12/2009 | Schulz et al. |
| 7,634,533 | B2 | 12/2009 | Rudolph et al. |
| 7,643,641 | B2 | 1/2010 | Haulick et al. |
| 7,831,035 | B2 | 11/2010 | Stokes et al. |
| 7,840,013 | B2 | 11/2010 | Dedieu et al. |
| 8,237,770 | B2 | 8/2012 | Kenoyer et al. |
| 2003/0103632 | A1 | 6/2003 | Goubran et al. |
| 2003/0157965 | A1 | 8/2003 | Marro et al. |
| 2003/0161485 | A1 | 8/2003 | Smith |
| 2004/0041902 | A1 | 3/2004 | Washington |
| 2004/0165735 | A1 | 8/2004 | Opitz |
| 2005/0084116 | A1 | 4/2005 | Schulz et al. |
| 2006/0256983 | A1 | 11/2006 | Kenoyer et al. |
| 2007/0260340 | A1 | 11/2007 | Mao |
| 2009/0012779 | A1 | 1/2009 | Ikeda et al. |

FOREIGN PATENT DOCUMENTS

| | | | |
|---|---|---|---|
| EP | 1377041 | A2 | 1/2004 |
| EP | 1571875 | A2 | 9/2005 |
| EP | 1856948 | | 11/2007 |
| EP | 1065909 | A2 | 6/2009 |
| JP | 2007-28391 | A | 2/2007 |
| JP | 2007-89058 | A | 4/2007 |
| WO | 0049602 | A1 | 8/2000 |
| WO | 01/31972 | A1 | 5/2001 |
| WO | 01/58209 | A1 | 8/2001 |
| WO | 03/075606 | A1 | 9/2003 |
| WO | 03/086009 | A1 | 10/2003 |
| WO | 2004/084577 | A1 | 9/2004 |
| WO | 2006/096959 | A1 | 9/2006 |
| WO | 2007088730 | A1 | 8/2007 |
| WO | 2008/040991 | A2 | 4/2008 |

OTHER PUBLICATIONS

Australian Patent Examination dated Jul. 10, 2014 corresponding to Australian Patent App. No. 2009287421, 3 pp.

Brandstein, et al.; "A practical methodology for speech source localization with microphone arrays"; Computer Speech and Language; 1997; II, pp. 91-126.

European Search Report dated Jan. 4, 2013 from EP 09809106.9, 11 pages.

International Search Report from corresponding PCT/AU200900100 Dated 18 Jan. 18, 2010.

Cohen et al., "Microphone array Post-filtering for Non-Stationary Noise Suppression". Acoustics, Speech, and Signal Processing, 2002, Proceedings ICASSP '02 IEEE International Conference vol. 1, 4 pps.

Cutler, et al., "Distributed Meetings: A Meeting Capture and Broadcasting System", Proceedings of the 10th ACM International Conference on Multimedia, pp. 503-512, 2005.

Grecu, Andrei, "Musical Instrument Separation", Vienna University of Technology, Oct. 15, 2007, 3 pps.

Lathoud, et al., "Sector-Based Detection for Hands-Free Speech Enhancement in Cars", Eurasip Journal on Applied Signal Processing, vol. 2006, pp. 1-15.

Li, et al., "Hemisperical Microphone Arrays for Sound Capture and Beamforming", 2005 IEEE Workshop on applications of signal Processing to Audio and Acoustics, Oct. 16-19, 2005, pp. 106-109.

Moore, et al., "Mcrophone Array Speech Recognition: Experiments on Overlapping Speech in Meetings", Dalle Molle Institute for Perceptual Artificial Intelligence (IDIAP), ICASSP '03 IEEE International Conference 2003, V-497 to V-500.

Valin, et al., "Enhanced Robot Audition Based on Microphone Array Source Separation with Post-Filter", Intelligent Robots and Systems, 2004, Proceedings 2004 IEEE/RSJ International Conference, vol. 3 pp. 2123-2128.

MICROPHONE ARRAY SYSTEM AND A METHOD FOR SOUND ACQUISITION

RELATED APPLICATION

This application is a continuation of U.S. patent application Ser. No. 13/061,359, filed on Feb. 28, 2011, which claims priority of PCT/AU2009/001100, filed on Aug. 26, 2009, the entire contents of both of which are hereby incorporated herein.

FIELD OF THE DISCLOSURE

This disclosure relates to a microphone array system and a method for sound acquisition from a plurality of sound sources in a reception space. The disclosure extends to a computer program product including computer readable instructions, which when executed by a computer, cause the computer to perform the method.

The disclosure further relates to a method for sound source location, and a method for filtering beamformer signals in a microphone array system. The disclosure extends to a microphone array for use with a microphone array system.

This disclosure relates particularly but not exclusively to a microphone array system for use in speech acquisition from a plurality of users or speakers surrounding the microphone array in a reception space such as a room, e.g., seated around a table in the room. It will therefore be convenient to hereinafter describe the disclosure with reference to this example application. However it is to be clearly understood that the disclosure is capable of broader application.

BACKGROUND OF THE DISCLOSURE

Microphone array systems are known and they enable spatial selectivity in the acquisition of acoustic signals, based on using principles of sound propagation and using signal processing techniques.

Table-top microphones are commonly used to acquire sounds such as speech from a group of users (speakers) seated around a table and having a conversation. The quality of the acquired sound with the microphone is adversely affected by sound propagation losses from the users to the microphone.

One way to reduce the losses in sound propagation is to use a microphone array system. The microphone array system includes, broadly, a plurality of microphone transducers that are arranged in a selected spatial arrangement relative to each other. The system also includes a microphone array interface for converting the microphone output signals into a different form suitable for processing by the computer. The system also includes a computing device such as a computer that receives and processes the microphone transducer output signals and a computer program that includes computer readable instructions, which when executed processes the microphone output signals. The computer, the computer readable instructions when executed, and the microphone array interface form structural and functional modules for the microphone array system.

Beamforming is a data processing technique used for processing the microphone transducers' output signals by the computer to favour sound reception from selected locations in a reception space around the microphone array. Beamforming techniques may be broadly classified as either data-independent (fixed) or data-dependent (adaptive) techniques.

Apart from sound acquisition enhancement from selected sound source locations in a reception space, a further advantage of microphone array systems is the ability to locate and track prominent sound sources in the reception space. Two common techniques of sound source location are known as the time difference of arrival (TDOA) method and the steered response power (SRP) method, and they can be used either alone or in combination.

Applicant believes that the development of prior microphone array systems for speech acquisition has mostly focused on applications for acquiring sound from a single user. Consequently microphone arrays in the form of linear or planar array geometries have been employed.

In scenarios having multiple sound sources, such as when a group of speakers are engaged in conversation, e.g. around a table, the sound source location or active speaker position in relation to the microphone array changes. In addition more than one speaker may speak at a given time, producing a significant amount of simultaneous speech from different speakers. In such an environment, the effective acquisition of sound requires beamforming to multiple locations in the reception space around the microphone array. This requires fast processing techniques to enable the sound source location and the beamforming techniques to reduce the risks of sound acquisition losses from any one of the potential sound sources.

Also, linear microphone array geometries that are known include limitations associated with the symmetry of their directivity patterns obtained from the microphone array. The problem of beam pattern symmetry is alleviated using microphone arrays having planar geometries. However its maximum directivity lies in its plane which limits its directivity in relation to sound source locations falling outside the plane. Such locations would for example be speakers seated around a table having their mouths elevated relative to the array plane.

Clearly therefore it would be advantageous if a contrivance or a method could be devised to at least ameliorate some of the shortcomings of prior microphone array systems as described above.

SUMMARY OF THE DISCLOSURE

A method embodiment according to the present disclosure processes output audio signals and comprises the steps of:

sampling the signals in a series of processing cycles to form discrete time domain signals;

in each processing cycle:

transforming the time domain signals into discrete frequency domain signals each having a set of defined frequency bins;

defining a pre-filter mask vector for each discrete signal for population with entries corresponding with respective frequency bins;

populating the pre-filter mask vector such that each entry has a defined high value if the value of the corresponding frequency bin is a highest value amongst associated frequency bins of the respective signals, otherwise each entry having a defined low value; and calculating an indicator value for each discrete signal using the entries populating the pre-filter mask vector.

In another method embodiment according to the present disclosure, the method further comprises in each processing cycle, the steps of:

defining a post-filter mask vector for each discrete signal;

populating the post-filter mask vector such that entries corresponding with entries in the pre-filter mask vector that are said high values are the indicator value and the remaining entries are values from a previous processing cycle scaled with an attenuating factor for decaying the value; and forming discrete filtered frequency domain signals by applying the post-filter mask vector to the frequency domain signals such that the signals associated with the indicator value are emphasised and the remaining signals are de-emphasised.

In another method embodiment according to the present disclosure, the method further comprises the step of combining the filtered frequency domain signals from each processing step into respective single output signals that are discrete in the frequency domain.

In another method embodiment according to the present disclosure, the method further comprises the step of transforming each single output signal into a time domain signal.

In another method embodiment according to the present disclosure, the method further comprises validating the discrete signals as signals from a valid sound source by comparing the indicator value with a threshold value for each discrete signal during each processing cycle.

In another method embodiment according to the present disclosure, the method further comprises the step of labelling validated discrete signals and storing the validated discrete signals together with a label during each processing cycle.

In another method embodiment according to the present disclosure, the method further comprises the step of linking the signals of each label and segmenting the signals into sound source segments.

In another method embodiment according to the present disclosure, the sound source segments are associated with speech utterances and each label is associated with a speaker identity.

In another method embodiment according to the present disclosure, a filtering stage is applied to the indicator values to smooth the indicator values over time.

In another method embodiment according to the present disclosure, the method comprises the step of applying the filtering stage further comprises the steps of associating a state with each of a number of discrete signal sources, and transitioning a state of a discrete signal source when the indicator value is higher than the threshold value for that source or demoting the status when the distribution value is lower than the threshold value for that source.

In another method embodiment according to the present disclosure, the indicator value for each discrete signal is calculated by using a selected distribution function as a function of the average value of said entries for that discrete signal.

In another method embodiment according to the present disclosure, the selected distribution function is a sigmoid function.

In another method embodiment according to the present disclosure, said defined high value is one and said defined low value is zero.

In another method embodiment according to the present disclosure, the method further comprises the steps of defining the pre-filter mask vector, populating the pre-filter mask vector and calculating the indicator value are with reference to a subset of the defined frequency bins, the frequency bins of the subset being those for a range of predetermined frequencies.

In another method embodiment according to the present disclosure, the audio signals are beamformer signals. The method further comprises the step of carrying out a beamforming calculation on microphone transducer output signals to generate the audio signals.

In another method embodiment according to the present disclosure, the microphone transducer output signals are received from an array of microphone transducers that are spatially arranged relative to each other within a reception space. The method further comprises conceptually dividing the reception space into spatial reception sectors so that beamformer signals can be associated with each reception sector.

A system embodiment according to the disclosure comprises a sound acquisition system for sound acquisition from multiple sound sources. The sound acquisition system comprises microphones for generating output signals. A microphone interface is configured to sample the output signals in a series of processing cycles to form discrete time domain signals. In each processing cycle, the time domain signals are transformed into discrete frequency domain signals, each having a set of defined frequency bins. A post-filter module is configured to define a pre-filter mask vector for each discrete signal for population with entries corresponding with respective frequency bins; to populate the pre-filter mask vector such that each entry has a defined high value if the value of the corresponding frequency bin is a highest value amongst associated frequency bins of the respective signals, otherwise each entry having a defined low value; and to calculate an indicator value for each discrete signal using the entries populating the pre-filter mask vector.

BRIEF DESCRIPTION OF THE DRAWINGS

Other and further objects, advantages and features of the present disclosure will be understood by reference to the following specification in conjunction with the accompanying drawings, in which like reference characters denote like elements of structure and.

DESCRIPTION OF THE PREFERRED EMBODIMENT

Figure 1:
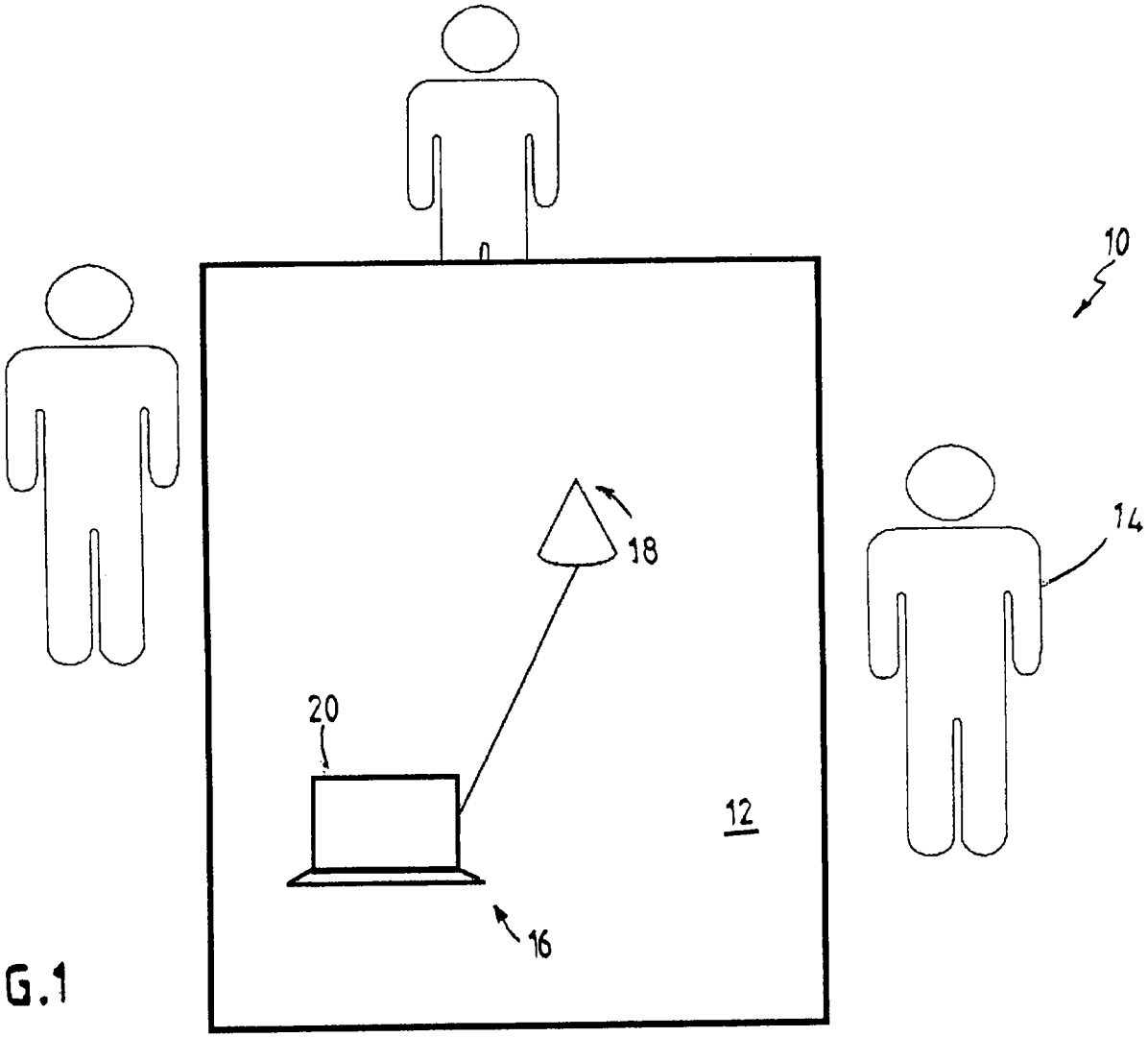
FIG. 1 shows schematically a meeting room in which users meet around a table, and a microphone array system, in accordance with the disclosure, in use, with a microphone array mounted on the table top.

Referring to FIG. 1, there is shown schematically a meeting room having a table 12 and a plurality of users 14 arranged around the table. Reference numeral 16 generally indicates a microphone array system 16, in accordance with the disclosure. Microphone array system 16 according to an embodiment of the disclosure includes a microphone array 18 mounted on the table-top 12 and a computer system 20 for receiving and processing output signals from the microphone array 18. The computer system is in the form of a personal computer (PC) 20 for receiving and processing the microphone output signals from the microphone array 18.

In another embodiment (not shown) of the disclosure, the microphone array system can be a stand alone device for example it can include the microphone array and an embedded microprocessor device.

Figure 2:
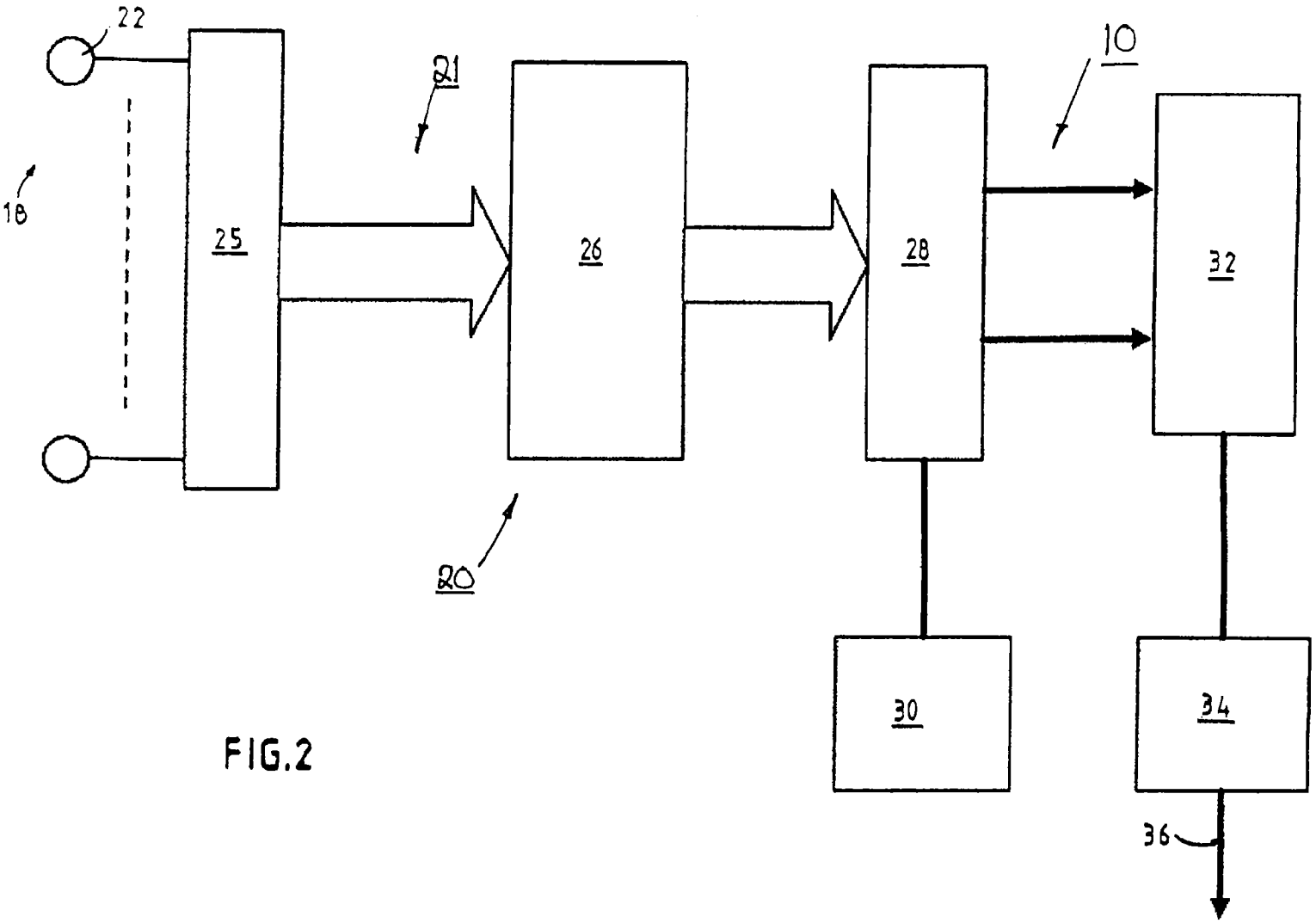
FIG. 2 shows a functional block diagram of the microphone array system in FIG. 1.

FIG. 2 shows a functional block diagram of the microphone array system 16. The microphone array system 16 is for sound acquisition in a reception space, such as the meeting room, from a plurality of potential sound sources namely the users 14. The microphone array system 16 includes the microphone array 18 that has a plurality of microphone transducers 22. The microphone transducers 22 (see FIG. 3) are arranged relative to each other to form an N-fold rotationally symmetrical microphone array about a vertical axis 24. The significance of the N-fold rotational symmetry is explained in more detail below.

The microphone array system 16 also includes a microphone array interface, generally indicated by reference numeral 21. The microphone array interface includes a sample-and-hold arrangement 25 for sampling the microphone output signals of the microphone transducers 22 to form discrete time domain microphone output signals, and for holding the discrete time domain signals in a sample buffer. Typically, the sample-and-hold arrangement 25 includes an analogue-to-digital converter module that can be provided by the PC or onboard the microphone array 18, and the sample buffer is provided by memory of the PC.

Further, the microphone array interface 21 includes a time-to-frequency conversion module 26 for transforming the discrete time domain microphone output signals into corresponding discrete frequency domain microphone signals having a defined set of frequency bins.

A beamformer module 28 forms part of the microphone array system 16 for receiving the discrete frequency domain microphone output signals. The beamformer 28 includes a set of defined beamformer weights corresponding to a set of candidate source location points spaced apart within one of N spatial reception sectors in the reception space surrounding the microphone array, the N spatial reception sectors corresponding to the N-fold rotational symmetry of the microphone array 18.

Figure 3B:
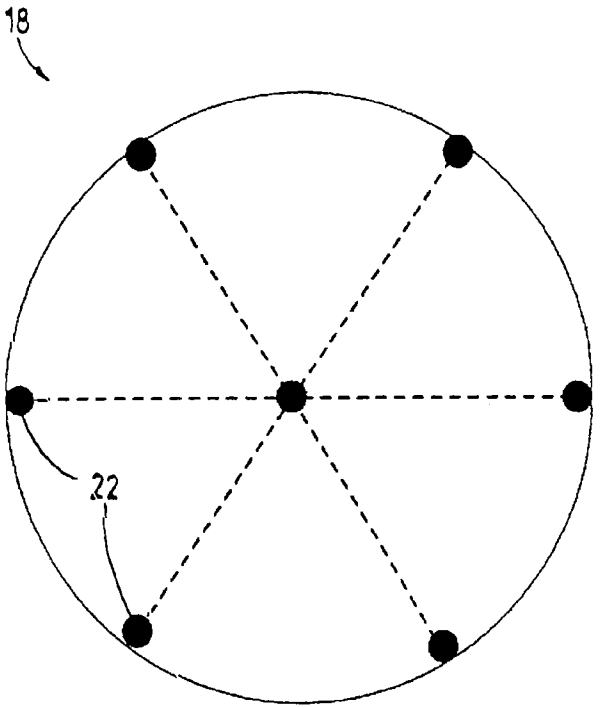
FIGS. 3A and 3B show schematically a three-dimensional view and a top view respectively of an arrangement of microphone transducers forming part of the microphone array in accordance with one embodiment of the disclosure.
Figure 3A:
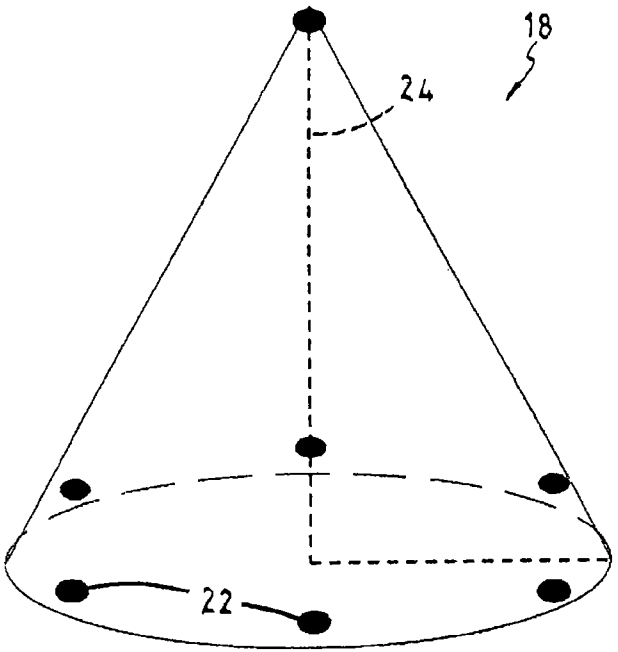
Figure 4:
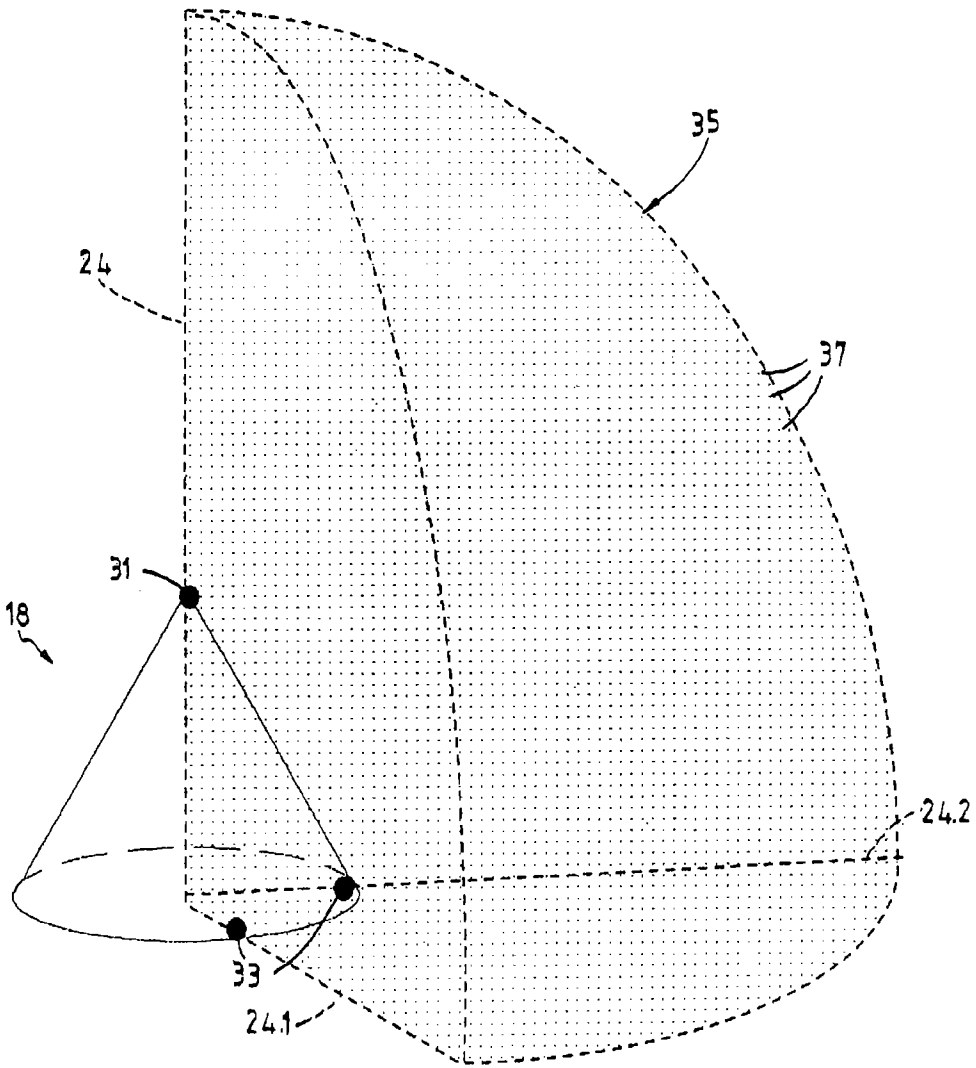
FIG. 4 shows schematically a spatial reception sector defined within a reception space surrounding the microphone array in FIG. 3.
Figure 5:
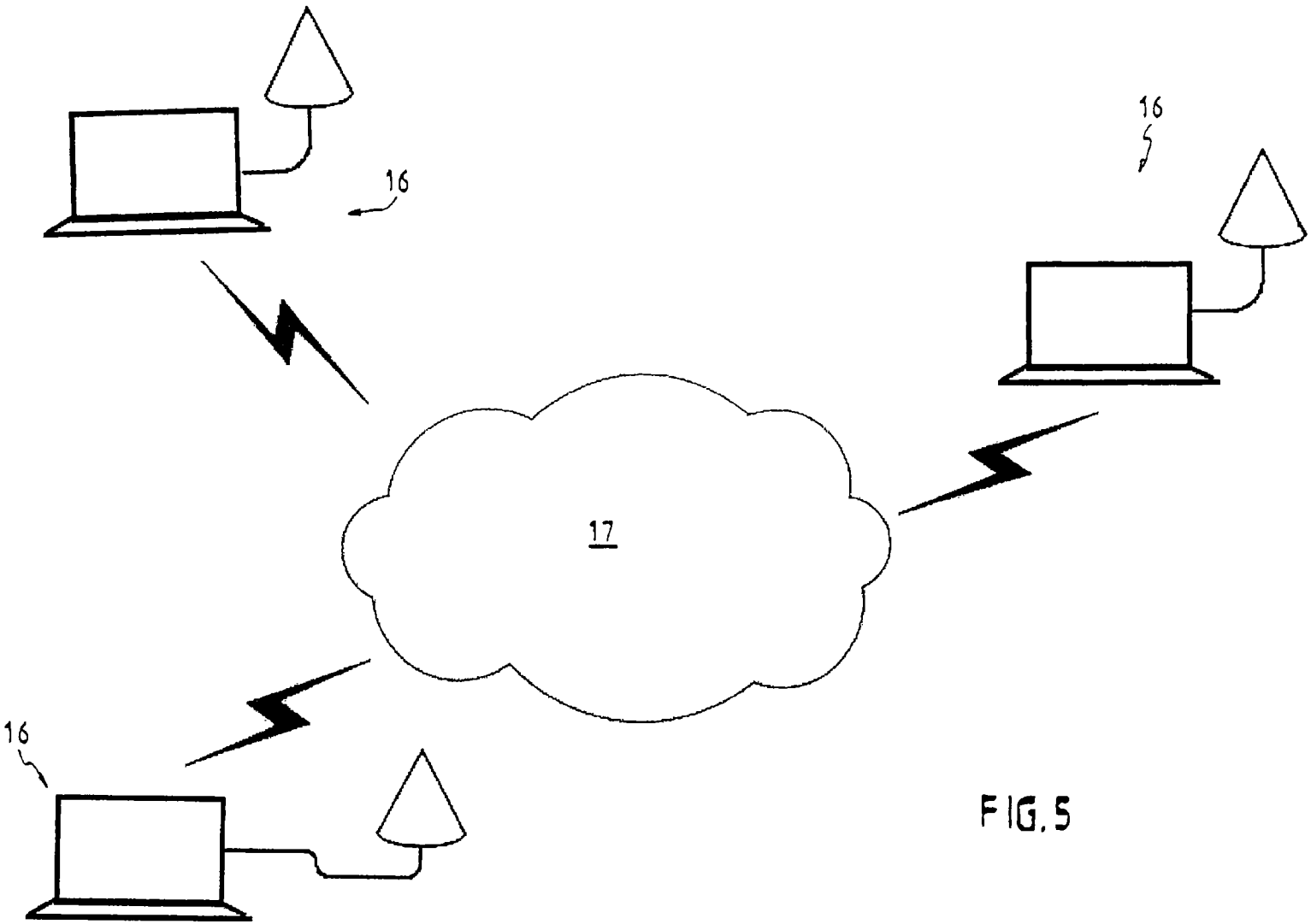
FIG. 5 shows schematically a plurality of microphone array systems that are connected to each other over a data communication network.

The microphone array 18, in this example, includes seven microphone transducers 22 that are arranged on apexes of a hexagonal pyramid (see FIG. 3). Thus, six microphone transducers 33 are arranged on apexes of a hexagon on a horizontal plane to form a horizontal base for the microphone array, and one central microphone transducer is axially spaced apart from the horizontal base on the central vertically extending axis 24 of the microphone array.

Such microphone array, thus, includes a 6-fold rotational symmetry about the vertical axis 24, so that each microphone triad is defined by two adjacent base microphones 33 and the central microphone 31, and that is associated with a spatial reception sector 35 radiating outwardly from the microphone triad, so that six equiangular spatial reception sectors are defined about the vertical axis 24 that form an N-fold rotationally symmetrical reception space about the vertical axis 24.

The spatial arrangement of the microphone transducers 22 thus also lies on a conceptual cone shaped space, with the base transducers on a pitch circle forming the base of the cone and the central microphone 31 at an apex of the cone. In the illustrated embodiment, shown in FIG. 3, the circular base of the cone has a radius of 3.5 cm, although in general this may be up to 15 cm. The height of the cone is 7 cm in the illustrated embodiment.

In this example, the microphone transducers 22 are omni-directional-type transducers. The microphone array 18 can include additional microphone transducers (not shown). For example at least two microphone transducers can be arranged on a pitch circle that coincides with a transverse circle formed by the outline of the cone shaped space intermediate the base and the apex of the cone.

The microphone array can also include an embedded visual display (not shown), such as a series of LEDs (light emitting diodes) located between the base and apex to provide visual signals to the users of the microphone array system 16.

Moreover, the microphone array can include a fixed steerable, or a panoramic, video camera (not shown), located on a surface of the cone between the base and apex, or at either extremity. The microphone array may have more than one camera. For example the microphone array may have cameras on two or more facets of the hexagonal pyramid. In one form separate cameras may be located on alternate facets of the hexagonal pyramid. In another form separate cameras may be located on each facet of the hexagonal pyramid.

The microphone array interface for the computer, such as the PC 20, can include any conventional interface technology, for example USB, Bluetooth, Wifi, or the like to communicate with the PC.

The reception space around the microphone array 18 is conceptually divided into identical spatial reception sectors 35 that are equiangularly spaced about the vertical axis, and each spatial reception sector is conceptually divided into a grid of candidate sound source location points 37 that are represented within the beamformer weights.

The set of beamformer weights is used to calculate beamformer output signals corresponding to the set of candidate source location points 36 that are spaced apart within one of the N spatial reception sectors 35. The candidate source location points are in the form of a grid of location points. Thus, a beamformer output signal is calculated for any one of the candidate sound source location points 36 in the spatial reception sector. The microphone indexes are angularly displaceable about the vertical axis 24 selectively into association with any one of the other N spatial reception sectors, thereby to use only one set of defined beamformer weights to calculate beamformer signals associated with any one of the spatial reception sectors.

By displacing the microphone indexes arithmetically angularly during a process cycle, the same set of beamformer weights that are used for calculating a beamformer output signal in one spatial reception sector can be used for calculating a beamformer output signal in any one of the other spatial reception sectors. Using a set of beamformer weights that is applicable by rotation to any other sector is possible by employing a discrete rotational symmetrical microphone array.

Using a conical microphone array arrangement as illustrated, each spatial reception sector is defined by equally sized wedges of the hemispherical space extending from the base centre of the microphone array device 18. Each wedge is defined between three radial axes 24, 24.1, and 24.2 that extend through the lines defined by a given triad of microphone transducers of the microphone array, wherein the triad consists of the elevated centre microphone transducer 31 and two adjacent base microphone transducers 33. The radial range of the wedge-shaped spatial reception sectors 35 is configurable, and will typically be of the order of several meters. In another embodiment, the spatial reception sectors can be defined between two radial axis extending from intermediate adjacent pairs of base microphone transducers.

The microphone array system 16 also includes a sound source location module 30 for determining a selected candidate sound source location point for each sector in which direction a primary beamformer output signal for each sector is to be calculated, during each processing cycle.

Broadly, the sound source location module 30 includes a sound source location point index comprising a selected sound source location point for each spatial reception sector 36. The sound source location point index, in this example, includes six selected sound source location points, one for each sector.

Thus, the beamformer module is configured to calculate during each process cycle, primary beamformer output signals associated with the selected sound source location points, so as to form a set of primary beamformer output signals. It will be appreciated that each primary beamformer output signal is in the form of a beamformer output signal vector having a defined set of frequency bins.

The distribution and number of sound source location points 37 defined within each sector 35 is based on considerations of computational complexity and spatial resolution. For illustrative purposes the spatial reception sector 36 is defined between the azimuth, elevation and radial range of a reception sector and is uniformly divided.

A vector of frequency domain filter-sum beamformer weights, $w_k(f)=\{w_{ik}(f)\}$ is defined between each microphone element i in the array and each sound source location point 26 ($k$). The beamformer weights are calculated according to any one of a variety of methods familiar to those skilled in the art. The methods include for example delay-sum or superdirective beamforming. These beamformer weights only need to be pre-calculated once for the microphone array configuration, as they do not require updating during each process cycle.

The beamformer weights that have been calculated for the sound source location points within one spatial reception sector can be used to obtain sound source location points selectively for any one of the other spatial reception sector, due to the symmetry of the microphone array 18 about the vertical axis 24. This is done by simply applying a rotation to the microphone indices of the beamformer weights, thereby increasing memory efficiency in the computer.

The sound source location module 30 is configured to update the sound source location point index that is used for calculating the primary beamformer output signals during each processing cycle. In this embodiment, the sound source location module 30 is configured to update only one of the selected sound source location points during each processing cycle. To this end, the sound source location module 30, in accordance with the disclosure, is configured to calculate primary beamformer output signals over a subset of frequency bins for a subset of candidate source location points in each spatial reception sector, as is explained in more detail below.

Using the defined beamformer weights, the sound source location module 30 determines the signal energy at each sound source location point localised around each selected sound source location point k within each spatial reception sector s, as:

$$E_s(k) = \sum_{f=f_1}^{f_2} |w_k^H(f) \times x(f)|$$

where x(f) is the frequency domain microphone output signals from each microphone, $(\ )^H$ denotes the complex conjugate transpose, and $f_1$ and $f_2$ define the subset of frequencies of interest, as described below. Note that to benefit from memory efficiencies as described above, the beamformer weights are appropriately rotated to the correct reception sector orientation as required.

Initially, the selected sound source location points for the spatial reception sectors are thus determined as the one with maximum energy, as:

$$k_s' = \underset{k}{\operatorname{argmax}}\, E(k)$$

Three deviations from this standard SRP grid search are implemented to improve computational efficiency and consistency of the estimated locations, namely:

First, in the above argmax step, the signal energy is determined in the directions of a subset of sound source location points localised around the selected candidate sound source location point, in other words within $\Delta_k$ steps from the selected sound source location point in selected directions. This reduces the search space in each spatial reception sector during the process cycle to $(1+2\Delta_k)^3$ points instead of the full $N_k$-sound source location points. Typically, $\Delta_k$ can be 1 or 2, yielding a search space that includes 9 or 125 points within each spatial reception sector.

Secondly, a secondary beamformer output signal is used during the search. That is, beamformer output signals are calculated using a selected sub set of frequencies $f_1 \leq f \leq f_2$ within a selected subset of frequencies that corresponds to a frequency band of sounds of interest within the reception space. For example, the subset of frequencies can include the typical range of the frequencies within the speech spectrum if speech is to be acquired. Most energy in the speech spectrum falls in a particular range of frequencies. For instance, telephone speech is typically band-limited to frequencies between 300-3200 Hertz without significant loss of intelligibility. A further consideration is that sound source localisation techniques are more accurate (i.e. have greater spatial resolution) at higher frequencies. A significant step that reduces computation, improves accuracy of estimates, and increases the sensitivity to speech over other sound sources, is therefore to restrict the SRP calculation to a particular frequency band of frequencies of interest. The exact frequency range can be designed to trade-off these concerns. However for speech acquisition this will typically occupy a subset of frequencies between 50 Hz to 8000 Hertz.

Thirdly, only one selected sound source location point within the sound source location point index is updated during each process cycle. The selected sound source location point that is updated is chosen as that with the greatest SRP determined during each process cycle, i.e.:

$$s_t = \underset{s}{\operatorname{argmax}} E_s(k_s')$$

in which the selected sound source location point is updated as $k_{s_t}=k_{s_t}'$. This improves the robustness and stability of estimates over time, as typically the higher energy estimates will be more accurate. Due to the non-stationary nature of the speech signal, the spatial reception sector that includes the highest energy sound source location point will vary from one process cycle to the next.

Once the source location point index is updated, then primary beamformer output signals are calculated in the directions of the updated selected sound source location points as:

$$y_s(f)=w_{k_s}^H x(f)$$

Note that to benefit from memory efficiencies as above, the beamformer weights are appropriately rotated about the vertical axis into each spatial reception sector successively.

Further, the microphone-array system 16 in this embodiment of the disclosure also includes a post-filter module 32 for filtering discrete signals having a set of defined frequency bins, such as the primary beamformer signals that each has a set of frequency bins. The post-filter module 32 is configured to define a pre-filter mask for each primary beamformer output signal, and to use the pre-filter mask to define a post-filter mask for each primary beamformer output signal.

The post-filter module is configured to compare the values of the entries in associated frequency bins of the beamformer output sector signals, and to allocate a value of 1 to an associated entry of the pre-filter mask vector for the beamformer output signal that has the highest (maximum) value at said frequency bin, and to allocate a value of 0 to every entry in the pre-filter mask that is not the maximum value of the frequency bins when compared to associated frequency bins of the beamformer vectors.

Thus, a pre-filter mask vector comprises entries of either the value one or the value zero in each frequency bin, in which a value of one indicates that for that frequency bin the beamformer signal had the maximum value amongst associated frequency bins of all the beamformer signals.

The post-filter module is also configured to calculate a post-filter mask vector for each beamformer output sector signal by determining an average entry value over a defined subset of frequency bins of each pre-filter mask vector. The subset of frequency bins may be selected for a range of speech frequencies, for example between 300 Hz and 3200 Hz. Thus, the average entry value that is obtained from each pre-filter mask vector provides a measure of speech activity in each sector during each processing cycle.

Further, the post-filter module is configured to calculate a distribution value that is associated with each average value entry according to a selected distribution function. The distribution function is described below.

The post-filter module is configured to enter the determined distribution values for each beamformer output signal into a frequency bin position of the post-filter mask vector that corresponds with frequency bin position having values of 1 in the associated frequency bins of the pre-filter mask vector.

The post-filter module is also configured to determine the existing entry values of the post-filter vector at those frequency bins that correspond with the frequency bin position of the pre-filter mask vectors that have a zero value, and to replace the existing entry values with the same value scaled by a de-weighting factor for attenuating those frequency bins.

The Applicant is aware that the spectrum of the additive combination of two speech signals can be well approximated by taking the maximum of the two individual spectra in each frequency bin, at each process cycle. This is essentially due to the sparse and varying nature of speech energy across frequency and time, which makes it highly unlikely that two concurrent speech signals will carry significant energy in the same frequency bin at the same time.

In other words, a masking pre-filter $h_s(f)$ is thus calculated in each sector s=1:S according to:

$$h_s(f) = \begin{cases} 1 & \text{if } s = \operatorname{argmax}_{s'} |y_{s'}(f)|^2,\ s' = 1{:}S \\ 0 & \text{otherwise} \end{cases}$$

We note that when only one person is actively speaking, the other beamformer output signals from the other sectors will essentially be providing an estimate of the background noise level, and so the post-filter also functions to reduce background noise. This pre-filter mask also has the benefit of low computational cost compared to other formulations which require the calculation of channel auto- and cross-spectral densities.

While the above pre-filter mask has been shown experimentally to reduce cross-talk between beamformer outputs, and lead to improved performance in speech recognition applications, the natural sound of the speech can be degraded by the highly non-stationary nature of the pre-filter transfer function, that is caused by the binary choice between a zero or unity weight.

To keep the benefits of the masking pre-filter whilst also retaining the natural intelligibility of the output for a human listener, a post-filter is derived as follows. First, an indicator of speech activity in each spatial reception sector s is defined as:

$$p_s(\text{speech}) = \frac{1}{1 - \alpha e^{(r_s - \beta)}}$$

where $$r_s = \frac{1}{f_2 - f_1} \sum_{f=f_1}^{f_2} h_s(f)$$

with $h_s(f)$ as defined above. Heuristics or empirical analysis may be used to set the parameters $\alpha$ and $\beta$ in this equation. For example, $\alpha$ can be set to equal 1 and $\beta$ can be set to be proportional to 1/S, for example 2/S.

Having defined the indicator of active speech in each sector for a given time step, a smoothed masking post-filter is defined as:

$$g_s(f) = \begin{cases} p_s(\text{speech}) & \text{if } h_s(f) = 1 \\ \gamma g_s'(f) & \text{othewise} \end{cases}$$

where $g_s'$ represents the post-filter weight at the previous time step, and $\gamma$ is a configurable parameter less than unity that controls the rate at which each weight decays after speech activity. In the illustrative embodiment, a value of $\gamma=0.75$ is used. A filtered beamformer output signals for each spatial reception sector is obtained as:

$$z_s(f)=g_s(f)y_s(f)$$

The microphone array system 16 also includes a mixer module 34 for mixing or combining the filtered beamformer output signals to form a single frequency domain output signal 36. The mixer module 34 is configured to multiply each element of each filtered beamformer output signal with a weighting factor, which weighting factor for each filtered beamformer output signal is selected as a function of its associated calculated average value.

The mixer module 34 includes a frequency-to-time converter module for converting the single frequency domain output signal to a time domain output signal.

More specifically, for real-time applications involving human listeners, it is necessary to provide a single output audio channel containing sound from all sectors.

Once the post-filtered output signal $z_s(f)$ for each sector has been calculated, a single audio output channel for the device is formed as:

$$z(f)=\sum_{s=1}^{S}\delta_s z_s(f)$$

where $\delta_s$ is a sector-dependent gain or weighting factor that may be adjusted directly by a user, effectively forming a sound output volume control for each sector. The above output speech stream can contain a low level distortion relative to the input speech due to the non-linear post-filter stage.

In order to mask these distortions in the output signal, an attenuated version of the centre microphone transducer output signal is applied to the single output signal. The centre microphone signal is weighted with a first weighting factor, and applied to the output signal to form a first noise masked output signal.

Thereafter, a low level of a generated white noise signal also including a second weighting factor is applied to the first noise masked output signal to form a second noise masked output signal.

The weighting of the centre microphone transducer signal is set heuristically as a proportion of the expected output noise level of the beamformer (i.e. in inverse proportion to the number of microphones).

The variance for the masking white noise can also be set heuristically as a proportion of the background noise level estimated during non-speech frames.

A computer program product having a set of computer readable instructions, when executed by a computer system, performs the method of the disclosure. The method is described in more detail with reference to pseudo-code snippets and FIGS. 6 to 9 that show basic flow diagrams of part of the pseudo-source code.

Figure 6:
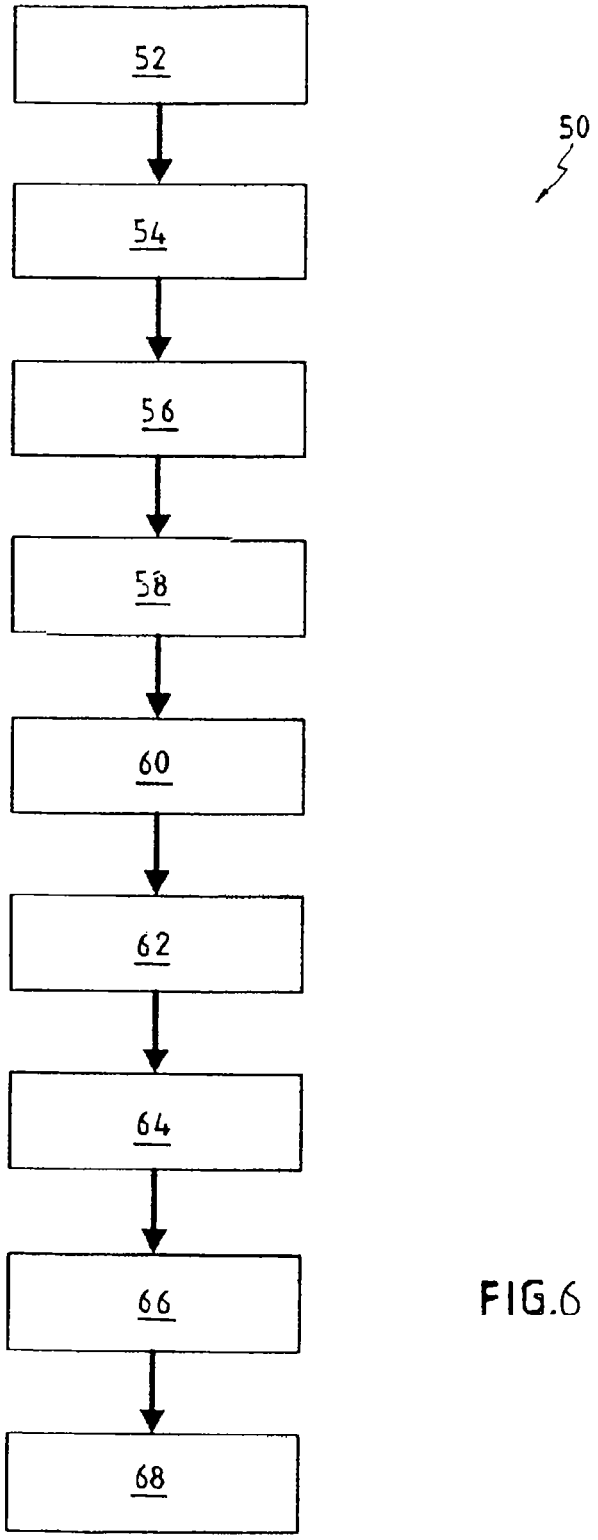
FIG. 6 shows a basic flow diagram of process steps forming part of a method of acquiring sound from a plurality of sound source locations, in accordance with one embodiment of the disclosure.

FIG. 6 shows a flow diagram 50 of a basic overview of a process cycle for acquiring sound from the reception space and for producing a single channel output signal. For purposes of illustration, a few variables for the computer program are defined as follows:

L=length of frame (number of samples)
Nm=number of input channels (microphones)
Ns=number of sectors
Np=number of points within sector localisation grid
Nf=number of frequency bins in the FFT
x=[Nm*L] matrix of real-valued inputs in time domain
W=[Np*Nm*Nf] matrix of complex frequency-domain beamformer filter weights for each grid point
P=[Ns*1] grid point indices
delta=[Ns*1] vector of gain factors set as a function of sector probability e.g. delta[s]=fn(pr[s])
epsilon=desired level for centre microphone signal in output mixture, set e.g. proportional to 1/Ns
sigma=level of white noise added to output mix, set e.g. proportional to estimated background noise level At 52, the discrete time domain microphone output signals are received from the microphone transducers 22 of the microphone array 18. The time domain microphone output signals are converted, at 54, into discrete frequency domain microphone signals by the time-to-frequency converter module 26. At 56, the location module 30 updates the sound source location point index, and the beamformer module 28 calculates, at 58, primary beamformer output signals for corresponding to the selected sound source location points of the sound source location point index.

The post-filter module 32 calculates, at 60, a post-filter mask for each primary beamformer output signal for each spatial reception sector, and the post-filter masks are applied, at 62, to the primary beamformer output signals to form the filtered beamformer output signals.

The mixer module 34 combines, at 64, the filtered beamformer output signals to form a single discrete frequency domain output signal. At 66, the discrete frequency domain output signal is converted to a discrete time domain output signal which is masked, at 68, with a noise masking signal.

At 52, the time domain microphone signals x are captured and stored by the PC.

The time domain microphone signals x are converted, at 54, to frequency domain microphone signals X using Fast Fourier Transform (FFT) i.e. X=fft(x), in which X is a Nm*Nf matrix of complex-valued frequency domain spectral coefficients.

Figure 7:
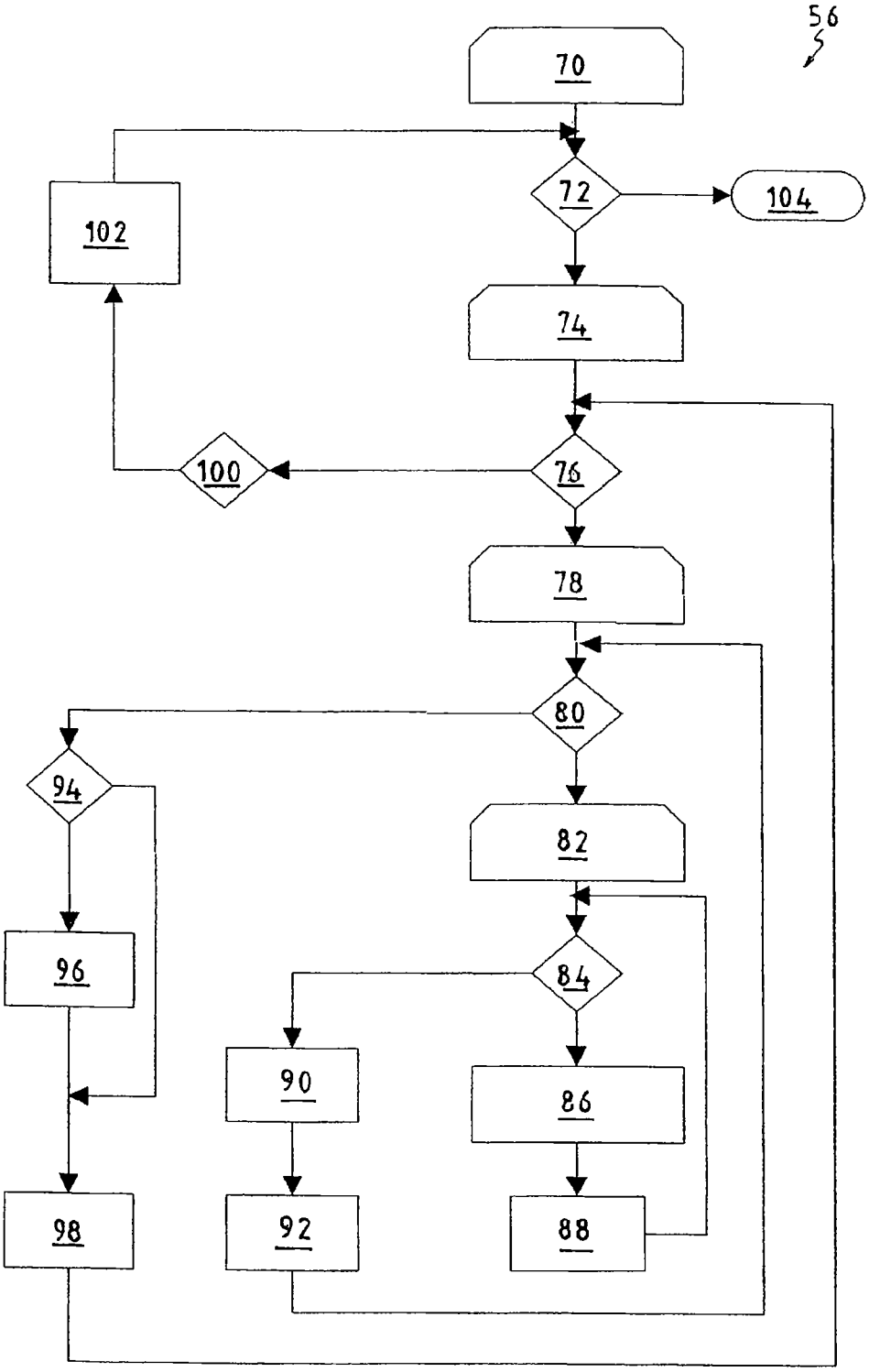
FIG. 7 shows a flow diagram of a method for sound source location steps forming part of the process steps in FIG. 6.

At, 56 the sound source location point index p is updated (see FIG. 7). A variable □Energy_MaxAllSectors is set to 0; and a for-loop, at 70, is executed for each sector s with s as loop counter, at 72. Within this loop a for-loop is executed, at 74, for each grid point p with p as loop counter, at 76, and within this loop a for-loop is executed, at 78, with each frequency in the subset of frequencies bins f1 to f2, with f as loop counter at 80. It is important to note that a subset of the frequency bins f1 to f2 is used in accordance with the disclosure.

Within the frequency loop, another for-loop is executed, at 82, for each microphone m with m as the loop counter, at 84. Within the m-loop a beamforming calculation is performed, at 86, as Y[s, f]=Y[s, f]+(X[m, f]*W[p, m, f]), and the loop counter m is updated, at 88.

```
Energy_MaxAllSectors = 0
    for each sector s
        Energy_MaxAllPoints = 0
        for each grid point p
            Energy_ThisPoint = 0
            for each frequency f between f1 and f2 (ie a subset of all
            Nf)
                Y[ s, f ] = 0
                for each microphone m
                    Y[ s, f ] = Y[ s, f ] + ( X[ m, f ] * W[ p, m, f ] )
                end
```

After the m-loop is completed, then the energy of the point p at the present frequency bin of the loop is calculated, at 90, and the frequency counter is updated, at 92. The energy value relating to each frequency for the point in loop is summated and stored in variable Energy_ThisPoint, and repeated until Energy_ThisPoint takes the total value of the energy for the point in loop.

```
        Energy_ThisPoint = Energy_ThisPoint + | Y[ s, f ] |^2
    end
```

During each iteration the maximum energy value of the points is stored, at 96, in variable Energy_MaxAllPoints, and the f counter is updated, at 98.

```
        if ( Energy_ThisPoint > Energy_MaxAllPoints )
            Energy_MaxAllPoints = Energy_ThisPoint
            pMax = p
        end
    end
```

At the end of the p-loop, once the point with highest energy has been determined, then the energy of the same point is tested, at 100, against the highest energy points of previous sectors, and the highest energy point amongst the sectors is stored in Energy_MaxAllSectors.

```
        if ( Energy_MaxAllPoints > Energy_MaxAllSectors)
            Energy_MaxAllSectors = Energy_MaxAllPoints
            sectorMax = s
            sectorPointMax = pMax
        end
    end
```

The s counter is updated, at 102, and the next sector is searched to find the highest energy point and then tested against the highest energy point found in the previous sectors, until the highest energy point amongst all the sectors is found. At this stage, the index entry belonging to the sector in which the highest energy point was found is updated.

P[sectorMax]=sectorPointMax

It is important to note that only one selected sound source location point of the sound source location point index is updated per process cycle, and the others remain the same as they were in the previous process cycle.

The sound source location point index is now updated, and is used by the beamformer module to calculate a primary beamformer output signal for each sector accordingly.

```
    for each sector s
    p = P[ s ]
        for each frequency f
        Y[ s, f ] = 0
            for each microphone m
                Y[ s, f ] = Y[ s, f ] + ( X[ m, f ] * W[ p, m, f ] )
            end
        end
    end
```

The beamformer output signals Y[s, f] for each sector are now calculated. Next, a post-filter for each beamformer signal is calculated. The post-filter mask is calculated in two steps. First a pre-filter mask H[s,f] is calculated that includes entries of ones and zeros, as the case may be, at its frequency bins. Thereafter, the pre-filter mask is used to calculate a post-filter mask G[s,f] that would ultimately be used to filter the beamformer output signals. A duplicate of G[s,f] is kept as G_previous[s,f] for use in the next process cycle.

Broadly, H[s,f] includes a pre-filter vector for each sector. The pre-filter vector is populated with either the value 1 or the value 0 at each of its frequency bins as follows.

Figure 8:
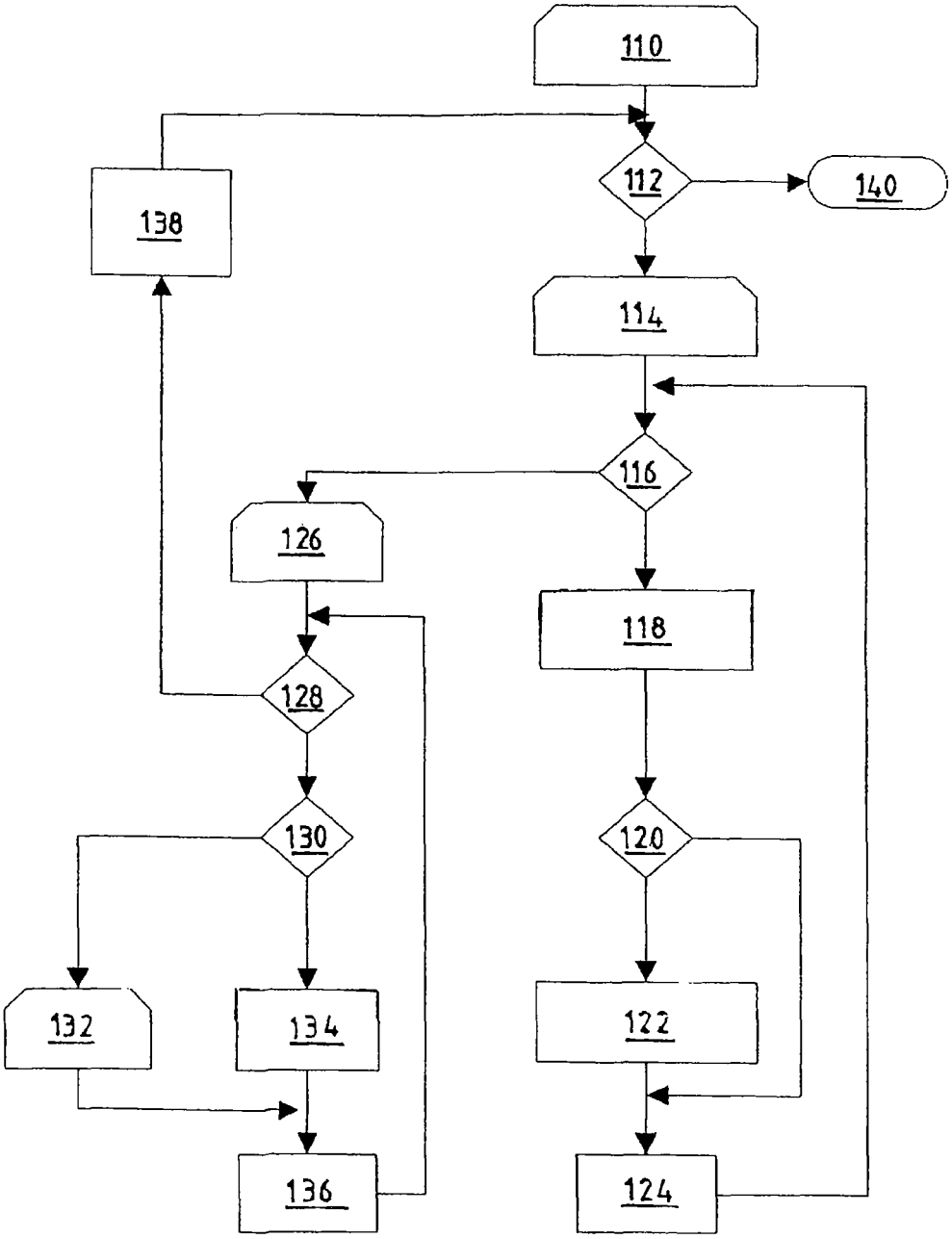
FIG. 8 shows a flow diagram of a method for calculating a pre-filter mask for beamformer output signals in accordance with one embodiment of the disclosure.

Referring to FIG. 8, a for-loop for each frequency bin is executed, at 110, with f as counter, at 112. Within this loop another loop for each sector s, at 114, with s as counter, at 116, is executed and the value of the element in the frequency bin f in loop of each beamformer signal is calculated at 118, and checked, at 120, to test if the value calculated is the highest compared to the values of the same frequency bins of the other beamformer sector values. At 122, a record is kept in variable maxSectors[f]=s of the sector s that has the highest value at the frequency bin in loop. The s counter is updated at 124 and the loop is repeated for all s.

```
for each frequency f
maxValue = 0
    for each sector s
        E = |Y[ s, f ] |^2
        if ( E > maxValue )
        maxValue = E
        maxSectors[f] = s
    end
end
```

When the sector having the highest value at the frequency bin in the loop is determined, the corresponding frequency bins of the pre-filter masks are populated with either the value 1 or 0 as the case may be. A for-loop is started at 126 for each sector s with counter s, at 128. At 130, the maxSectors[f] is used to check if the sector in the loop had the highest value at the frequency bin in the loop, and if it did, then the corresponding frequency bin of H[s,f] for that sector is set, at 134, to 1, and if not, then the corresponding frequency bin of H[s,f] for that sector is set, at 132, to 0. The sector counter s is updated at 136. Once the values, at the frequency bin f that is in the loop, of all the pre-filter masks for all the sector are set, at 128, then the f counter is updated, at 138, and the loop repeats for the next frequency bin.

```
for each sector s
    if ( maxSectors[f] == s )
        H[ s, f ] = 1
    else
        H[ s, f ] = 0
    end
    end
end
```

Figure 9:
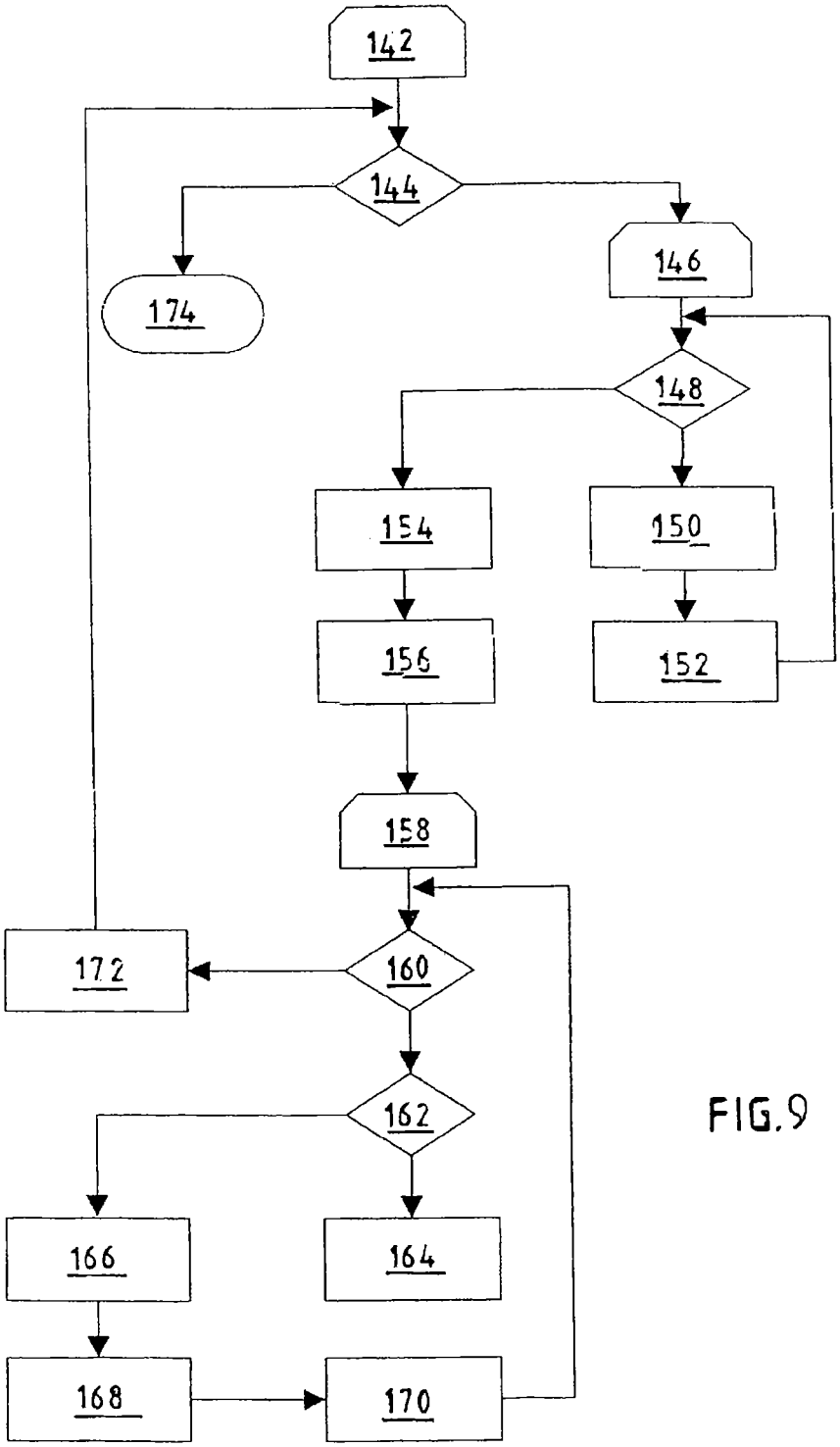
FIG. 9 shows a flow diagram for calculating a post-filter mask in accordance with one embodiment of the disclosure using the pre-filter mask vector in FIG. 8.

Once all the frequency bins of all the pre-filters masks are set, then the frequency loop exits, at 112, and at 140 the post-filter mask procedure is executed as illustrated in FIG. 9.

At 142, a for-loop is executed for each sector s with s as the loop counter, at 144. Within this loop, another for-loop is executed, at 146, for each frequency bin in the sub set of frequency bins f1 to f2, with f as loop counter, at 148. At 150, the values of each frequency bin in the subset f1 to f2 is added to the previous one and the f counter is updated, at 152, until the values of all the frequency bins in f1 to f2 is summated to form r[s]. At 154, the average value of the frequency bins f1 to f2 is calculated, and at 156, the average value is transformed according to a selected distribution function.

```
for each sector s
r[ s ] = 0
for each frequency f from f1 to f2
    [ s ] = r[ s ] + H[ s, f ]
end
r[ s ] = r[ s ] / ( f2 − f1 )
pr[ s ] = 1 / ( 1 − (alpha x exp( r[s] − beta )) )
```

Thereafter, at 158, a for-loop is executed over all the frequency bins with f as loop counter, at 160. At 162, a check is performed to determine if the value of the frequency bin presently in loop of H[s,f] is equal to one, and if it is, then the corresponding frequency bin in G[s,f] is populated with the transformed average value that was calculated with the sector in loop, at 164. If the value in the frequency bin in loop of H[s,f] is equal to 0, then the corresponding frequency bin of the G[s,f] is set, at 166, to the value it had in the previous process cycle times a weighting factor for decaying the value, and the new value is saved, at 168, in G_previous [s,f]. The f loop counter is then updated, at 170. When the f loop counter reaches its final count, then the s counter is updated, at 172.

```
for each frequency f
    if ( H[ s, f ] = 1 )
        G[ s, f ] = pr[ s ]
    else
        G[ s, f ] = gamma * G_previous[ s, f ]
    end
    G_previous[ s, f ] = G[ s, f ]
end
end
```

Once g[s,f] is calculated, then it is applied, at 174, to the beamformer output signals to form the filtered beamformer output signals as Z[s,f].

```
for each sector s
    for each frequency f
        Z[ s, f ] = Y[ s, f ] * G[ s, f ]
    end
end
```

Then, the filtered beamformer output signals are combined into a single output signal Z_out[f] that is discrete in the frequency domain. The separate filtered beamformer signals are multiplied with a factor delta[s] before it is combined or added to the other filtered beamformer signals. The factors in delta[s] are used further to emphasise the stronger signals and de-emphasise the weaker signals. The values in delta[s] can be, for example, the transformed average values that were calculated for the sector.

```
for each frequency f
Z_out[ f ] = 0
    for each sector s
```

-continued

```
        Z_out[ f ] = Z_out[ f ] + ( delta[ s ] * Z[ s, f ] )
    end
end
```

An Inverse Fast Fourier Transform is then performed on the output signal to convert it to a time domain signal.

z_mix_out[n]=IFFT(Z_out)

Also, an IFFT is performed on each beamformer signal separately.

for each sector output, z_sector_out[s,n]=IFFT(Z[s, f])

A noise masking signal is then calculated by selecting one of the microphone signals x[m,n], for example x[1,n], and adding it to a randomly generated white noise signal. The microphone signal from the central microphone can be used. Also, a further damping or weighting factor epsilon can be applied to for adjusting the ratio or amplitude between the signals. The same can be done for the separate sector signals, z_sector-out[s,n]

```
for each sample n
    z_mix_out[ n ] = z_mix_out[ n ] + ( epsilon * x[ 1, n ] ) + ( sigma * randomValue )
    for each sector s
        z_sector_out[s,n] = z_sector_out[s, n ] + ( epsilon * x[ 1, n ] ) + ( sigma * randomValue
)
    end
end
```

The microphone array system in this embodiment of the disclosure also includes a sound source association module (not shown) for associating a sound source signal that is detected within a spatial reception sector with a sound source in the spatial reception sector. The sound source association module, in this example, is configured to receive a stream of sound signals from each spatial reception sector during successive processing cycles, and to validate the stream of sound source signals as a valid sound source signal if it meets a predetermined criteria. The sound source association module is configured to label the valid sound source signal and to store the sound source signal and its sound source label in a sound record or history database for later retrieval.

More specifically, the sound source signals are linked and segmented into sound source segments. In this example, the sound source signals are expected to contain speech and the sound sources are speakers. Thus, a method is described for segmenting the audio into speech utterances, and then associating a speaker identity label with each utterance.

The post-filter described above incorporates a measure of speech probability for each sector, $p_s$(speech). This probability value is computed for each process cycle. In order to segment each sector into a sequence of utterances (with intermediate non-speech segments), a filtering stage is applied to smooth these raw speech probability values over time.

One such illustrative filtering stage is described in the following description and it includes a state-machine module that has four states. Any one of the states may be associated with a sound source sector signal during each processing cycle.

As is explained in more detail below, the state-machine module is configured to compare a transformation value of each sector against a threshold value, and to promote the status of the state-machine module to a higher status if the transformation value is higher than the threshold value, and demote the status to a lower status if the transformation value is lower than the threshold value.

More specifically, the filtering is implemented as a state machine module containing four states: inactive, pre-active, active and post-active, initialised to the inactive state. A transition to the pre-active state occurs when speech activity (defined as $p_s$(speech)>0.5) occurs for a given frame. In the pre-active state, the machine either waits for a specified number of active frames before confirming the utterance in the active state, or else returns to the inactive state.

The machine remains in the active state while active frames occur, and transitions to the post-active state once an inactive frame occurs. In the post-active state, the machine either returns to the active state after an active frame, or else returns to the inactive state after waiting a specified number of frames.

This segmentation stage outputs a Boolean value for each sector and each frame. The value is true if the sector is currently in the active or post-active state, and false otherwise. In this way, the audio stream in each sector is segmented into a sequence of multi-frame speech utterances. A location is associated with each utterance as the weighted centroid of locations for each active frame, where each frame location is determined as described above.

The preceding segmentation stage produces a sequence of utterances within each sector. Each utterance is defined by the enhanced speech signal together with its location within a sector. This section describes a method to group these utterances according to the person who spoke them. In order to associate a speaker label with these utterances, it is first assumed by definition that a single utterance belongs only to a single person. From the first utterance, an initial group is created. For all subsequent utterances, a comparison is performed to decide whether to (a) associate the utterance with one of the existing utterance groups, or (b) create a new group containing the utterance. In order to associate a new utterance to an existing utterance group, a comparison function is defined based on the following available parameters:

a) The time interval during which the utterance occurred.

b) The location at which the utterance occurred.

c) The spectral characteristics of the speech signal throughout the utterance.

A range of comparison functions may be implemented based on these measured parameters. In the illustrative embodiment, a two step comparison is proposed:

i) Firstly, it is assumed that utterances that occur close to each other in both time and location belong to the same person. Proximity in time and location may be defined by comparing each to a heuristic distance threshold, such as within 30 seconds and 30 degrees of separation in the azimuth plane. If a new utterance occurs within the time and distance thresholds of the most recent from an existing utterance group, it is merged with that group.

ii) If the utterance does not pass the first comparison step for any existing group, then the utterance may be compared according to the spectral characteristics of the speech. This may be performed either using automated speaker clustering measures, or else automated speaker identification software (using either existing stored speaker models, or models trained ad-hoc on existing utterances within the group).

Following application of the above steps, the sequence of utterances will be associated into a number of groups, where each group may be assumed to represent a single person. A label (identity) may be associated with each person (utterance group) by either prompting the user to input a name, or else using the label associated with an existing speaker identification voice model.

Typically, the first time a given person uses the device, a user must be prompted to enter their name. A voice model can then be created based on the group of utterances by that person. For subsequent usage by that person, their name may be automatically assigned according to the stored voice model.

Advantageously, the system 16 uses an N-fold rotationally symmetrical microphone array, and thus enables the use of a beamformer that uses the same set of beamformer weights for calculating a beamformer output signal for each sector. This means that less beamformer weight needs to be defined for catering for all the sectors, and this saves computer memory.

Another advantage is that the processing time is reduced by performing sound source location, using SRP, over a subset of frequency bins f1 to f2, as opposed to the full range of frequency bins. Also, searching only over a subset of grid points, and updating only one sound source index position for one sector, further reduces the number of process steps and thus the process cycle time.

Another advantage of the cone described above with reference to the drawings is that it reduces the required number of microphone elements when compared to spherical and hemispherical array structures. This reduces cost and computational complexity, with a minimal loss in directivity. This is particularly so when sources can be to occupy locations distributed around the cone's centre, as in the case of people arranged the perimeter of a table.

Further, the system 16 detects periods of speech activity, and determines the location of the person relative to other people in the reception space.

The system 16 produces a high quality speech stream in which the levels of all other speakers and noise sources have been audibly reduced. Also, the system 16 is able to identify a person, where a named voice model has been stored from prior use sessions.

Extraction of a temporal sequence of speech characteristics, including, but not limited to, active speaker time, pitch, and sound pressure level, and calculation of statistics based on the above extracted characteristics, including, but not limited to, total time spent talking, mean and variance of utterance duration, pitch and sound pressure levels is advantageously able to be provided by the system.

To this end, for the group of all speaking persons, a production of a single audio channel that contains a high quality mixture of all speakers is obtained, and provision is made for a mechanism for users to control the relative volume of each speaking person in this mixed output channel.

The system 16 also permits calculation of global measures and statistics derived from measures and statistics of an individual person.

It will of course be realized that the above has been given only by way of illustrative example of the disclosure and that all such modifications and variations thereto, as would be apparent to persons skilled in the art, are deemed to fall within the broad scope and ambit of the disclosure as is herein set forth.

What is claimed is:

1. A method for processing output audio signals, the method including the steps of:

sampling the audio signals in a series of processing cycles to form discrete time domain signals;

in each processing cycle:

transforming the time domain signals into discrete frequency domain signals that each have a set of defined frequency bins;

defining a pre-filter mask vector for each discrete frequency domain signal for population with entries corresponding with respective frequency bins;

populating the pre-filter mask vector such that each entry has a defined high value if a value of the corresponding frequency bin is a highest value amongst associated frequency bins of the respective discrete frequency domain signals, otherwise each entry having a defined low value;

calculating an indicator value for each discrete frequency domain signal using the entries populating the pre-filter mask vector;

defining a post-filter mask vector for each discrete frequency domain signal with entries corresponding to the entries of the pre-filter mask vector;

populating the post-filter mask vector such that entries of the post-filter mask vector corresponding with entries in the pre-filter mask vector that are said high values are the indicator value and the remaining entries of the post-filter mask vector are prior values from a previous processing cycle scaled with an attenuating factor for decaying the prior value; and forming discrete filtered frequency domain signals by applying the post-filter mask vector to the frequency domain signals such that the audio signals associated with the indicator value are emphasised and the remaining audio signals are de-emphasised.

2. The method as claimed in claim 1, which includes the step of combining the filtered frequency domain signals from each processing cycle into respective single output signals that are discrete in the frequency domain.

3. The method as claimed in claim 2, which includes the step of transforming the respective single output signals into respective time domain signals.

4. The method as claimed in claim 1, which includes the step of validating the discrete frequency domain signals as signals from a valid sound source by comparing the indicator value with a threshold value for each discrete frequency domain signal during each processing cycle.

5. The method as claimed in claim 4, which includes the step of labelling validated discrete frequency domain signals and storing the validated discrete frequency domain signals together with a label during each processing cycle.

6. The method as claimed in claim 5, which includes the step of linking the validated discrete frequency domain signals of each label and segmenting the validated discrete frequency domain the signals into sound source segments.

7. The method as claimed in claim 6, which includes the step of associating the sound source segments with speech utterances and associating each label with a speaker identity.

8. The method as claimed in claim 7, which includes the step of applying a filtering stage to the indicator values to smooth the indicator values over time.

9. The method as claimed in claim 8, in which the step of applying the filtering stage includes the steps of associating a state with each of a number of the discrete frequency domain signals, and transitioning the state of a given discrete frequency domain signal when the indicator value is higher than the threshold value for the given discrete frequency domain signal or demoting the state of the given discrete frequency domain signal when the indicator value is lower than the threshold value for the given discrete frequency domain signal.

10. The method as claimed in claim 1, which includes the step of calculating the indicator value for each discrete frequency domain signal by using a selected distribution function as a function of the average value of said entries of the pre-filter mask vector for that discrete frequency domain signal.

11. The method as claimed in claim 10, in which the selected distribution function is a sigmoid function.

12. The method as claimed in claim 1, in which the defined high value is one and the defined low value is zero.

13. The method as claimed in claim 1, in which the steps of defining the pre-filter mask vector, populating the pre-filter mask vector and calculating the indicator value are with reference to a subset of the defined frequency bins, the frequency bins of the subset being those for a range of predetermined frequencies.

14. The method as claimed in claim 1, in which the audio signals are beamformer signals, the method including the step of carrying out a beamforming calculation on microphone transducer output signals to generate the audio signals.

15. The method as claimed in claim 14, in which the microphone transducer output signals are received from an array of microphone transducers that are spatially arranged relative to each other within a reception space, the method including the step of conceptually dividing the reception space into spatial reception sectors so that beamformer signals can be associated with each reception sector.

16. A sound acquisition system for sound acquisition from multiple sound sources, the system including:

microphones for generating output signals;

a microphone interface that is configured to sample the output signals in a series of processing cycles to form discrete time domain signals and, in each processing cycle, to transform the time domain signals into discrete frequency domain signals, each having a set of defined frequency bins;

a post-filter module that is configured to:

define a pre-filter mask vector for each discrete frequency domain signal for population with entries corresponding with respective frequency bins;

populate the pre-filter mask vector such that each entry has a defined high value if a value of the corresponding frequency bin is a highest value amongst associated frequency bins of the respective discrete frequency domain signals, otherwise each entry having a defined low value;

calculate an indicator value for each discrete frequency domain signal using the entries populating the pre-filter mask vector;

define a post-filter mask vector for each discrete frequency domain signal with entries corresponding to the entires of the pre-filter mask vector;

populate the post-filter mask vector such that entries of the post-filter mask vector corresponding with entries in the pre-filter mask vector that are said high values are the indicator value and the remaining entries of the post-filter mask vector are prior values from a previous processing cycle scaled with an attenuating factor for decaying the prior value; and form discrete filtered frequency domain signals by applying the post-filter mask vector to the frequency domain signals such that the output signals associated with the indicator value are emphasised and the remaining output signals are de-emphasised.

* * * * *